United States Patent [19]

Trelease

[11] 4,171,621

[45] Oct. 23, 1979

[54] FREEZE PROTECTION DEVICE IN HEAT PUMP SYSTEM

[75] Inventor: Stephen W. Trelease, Louisville, Ky.

[73] Assignee: American Air Filter Company, Inc., Louisville, Ky.

[21] Appl. No.: 478,530

[22] Filed: Jun. 12, 1974

Related U.S. Application Data

[63] Continuation-in-part of Ser. No. 343,521, Mar. 21, 1973, abandoned.

[51] Int. Cl.[2] ..... F25B 13/00

[52] U.S. Cl. ..... 62/160; 62/201; 62/180; 237/2 B

[58] Field of Search ..... 237/2 B; 62/201, 434, 62/185, 180, 139, 160; 165/18, 50

[56] References Cited

U.S. PATENT DOCUMENTS

| | | | |
|---|---|---|---|
| 2,128,794 | 8/1938 | Billings | 62/201 |
| 2,496,466 | 2/1950 | Graham | 62/201 |
| 2,594,502 | 4/1952 | Sahs | 62/201 |
| 2,715,514 | 8/1955 | Stair | 165/2 |
| 3,165,148 | 1/1965 | Soule | 165/50 |
| 3,271,969 | 9/1966 | Lorentzen | 62/515 |
| 3,523,575 | 8/1970 | Olivieri | 165/18 |
| 3,630,271 | 12/1971 | Brody | 165/50 |
| 3,734,402 | 5/1973 | Morgan | 236/21 B |

*Primary Examiner*—William E. Wayner
*Assistant Examiner*—William E. Tapolcai, Jr.
*Attorney, Agent, or Firm*—Jon C. Winger

[57] ABSTRACT

A water source heat pump system having a plurality of zone air conditioning units, each unit adapted for selectively heating or cooling a zone independent of other units, each air conditioning unit having an air conditioner coil, a heat exchanger of the type having a water contact coil disposed within a housing, a refrigerant compressor, and refrigerant control means operable to selectively cause the air conditioner coil to act as a refrigerant evaporator or condenser and the water contact coil heat exchanger to act as a refrigerant condenser or evaporator, the water contact coil heat exchanger utilizing thermostat control means to control the operation of the air conditioning unit so as to prevent freezing of water in the water contact coil heat exchanger.

3 Claims, 2 Drawing Figures

FREEZE PROTECTION DEVICE IN HEAT PUMP SYSTEM

CROSS REFERENCE TO RELATED APPLICATIONS

Figure 1:
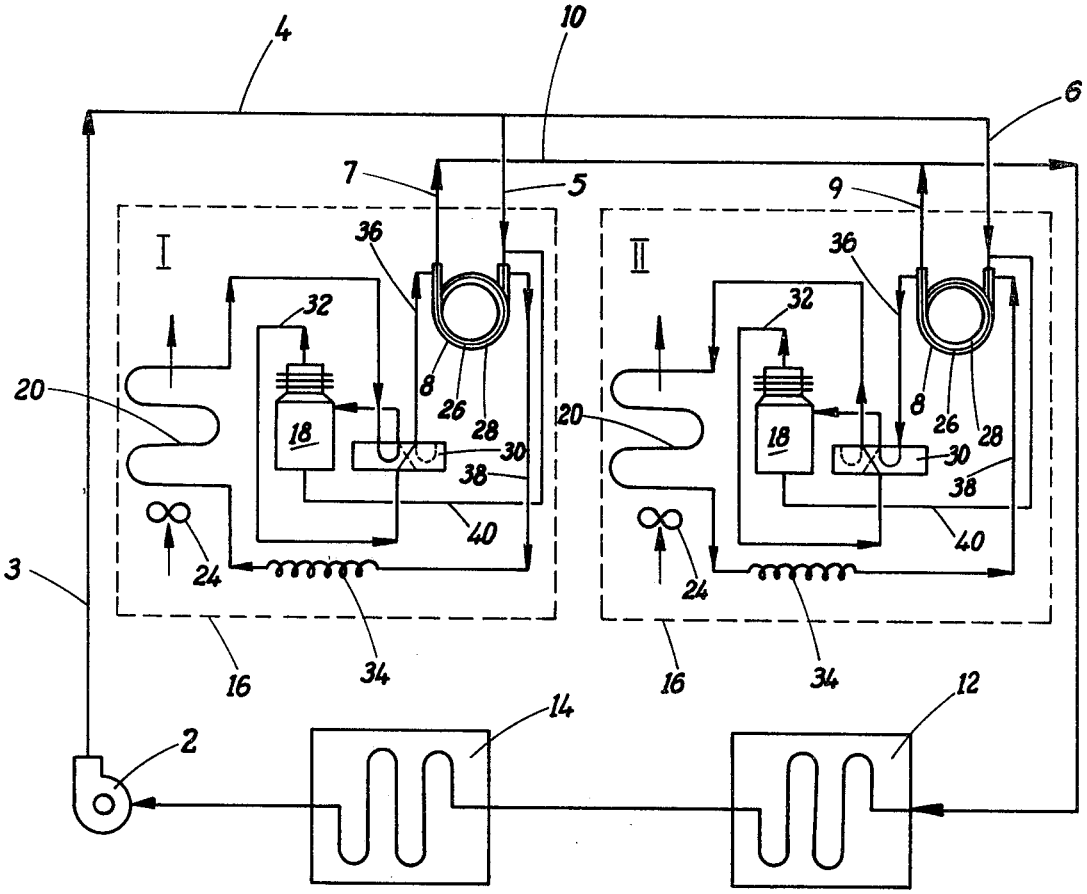

The present invention is a continuation-in-part of co-pending application, Ser. No. 343,521, filed Mar. 21, 1973 by Stephen W. Trelease, now abandoned.

BACKGROUND OF THE INVENTION

The invention relates to a water source heat pump system and more particularly relates to an air conditioning unit in a heat pump system utilizing a heat exchanger of the type having a water contact coil within a housing, with an aquastat disposed within the water contact coil to monitor the temperature of water passing therethrough.

Water source heat pump systems are those in which heat is injected into or extracted from flowing water, and the heat thus transferred is utilized to cool or heat air. Generally, the air to be conditioned by a water source heat pump is confined to selected zones within an enclosed building, such as, for example, rooms in a building where the temperature in each room is to be individually controlled. Each zone or room, for example, may contain an air conditioning unit to communicate with the water in the water source heat pump system. In utilizing the water in this manner, some air conditioning units may be heating while other air conditioning units may be cooling. In many cases, the means for transferring heat from the flowing water to the air conditioning unit is a water contact coil within a housing having a refrigerant therein such as a tube-in-tube heat exchanger or a water coil in a shell housing type heat exchanger. For example, in a tube-in-tube heat exchanger water flows through one tube and a refrigerant flows in the other with the heat being transferred according to the requirements of the air conditioning unit. If it is desired to put an air conditioner on a heating cycle where it is necessary to extract heat from the circulating water in the tube-in-tube heat exchanger, the water in the tube-in-tube heat exchanger gives up heat to the refrigerant passing through the exchanger thereby reducing the temperature of the water passing therethrough. In some cases, it has been found that the refrigerant entering the tube-in-tube exchanger is at a temperature below the freezing point of water and reduces the temperature of the water in the tube-in-tube exchanger to the freezing point of water thereby stopping the flow of water through the exchanger and subsequently causing problems in the operation of the air conditioning unit. In order to overcome this problem of water freezing in the tube-in-tube exchanger, several arrangements have been proposed. None herebefore have, however, proved to completely alleviate this problem. For example, one means proposed to prevent the freeze-up problem is to install a refrigerant suction pressure and/or temperature control device in or on the refrigerant line downstream of the heat exchanger so that at a preselected pressure or temperature, the air conditioning unit shuts down. However, this has proved unsatisfactory in that the refrigerant pressure or temperature control devices also shut down the air conditioner even when water flow and temperature are within safe limits. This is because the means to monitor the water condition is indirect and subject to conditions other than the temperature of the water, such as cold ambient air. Other suggested means have been to attach a temperature sensing device to the outside wall of the water conduit downstream of the heat exchanger or to install a temperature sensing device in the water stream downstream of the heat exchanger. In either of these cases, if the water flow is stopped for any reason, water does not flow from the exchanger and the temperature within is not reflected in the temperature sensing device as it is dependent upon water flowing from the heat exchange unit.

SUMMARY OF THE INVENTION

In the present invention, it is recognized that it is desirable to provide a means for preventing the freeze-up of water in a water coil within a refrigerant containing housing type heat exchanger wherein water is being utilized to transfer heat to the refrigerant. Furthermore, it is recognized that it is desirable to provide a means for preventing the freeze-up of water in the water coil utilizing a temperature sensing device disposed within the water stream of the water coil which is responsive in combination with thermostatic control means to a drop to a preselected temperature of the water in the coil, this temperature being above the freezing point of water.

The present invention advantageously provides a straightforward arrangement for the utilization of an aquastat in a water coil within a refrigerant containing housing type heat exchanger utilized in a water source heat pump system. The present invention further provides thermostat control means adapted to control the temperature of water in the water coil. The present invention also provides thermostat control means for preventing the freeze-up of water in a heat exchanger having a water coil therein which is utilized in an air conditioning unit.

Various other features of the present invention will become obvious to those skilled in the art upon reading the disclosure set forth hereinafter.

More particularly, the present invention provides in a heating and cooling system for buildings, the system being operable to provide simultaneous and selective heating or cooling in a plurality of zones, the system comprising at least one air conditioning unit per zone, the air conditioning unit comprising reversible refrigeration machines which individually include a heat exchanger having a water coil therein, a refrigerant compressor, an air conditioning heat exchanger, and refrigerant control means operable to selectively cause the water coil type exchanger to act as a refrigerant evaporator and the air conditioning heat exchanger to act as a refrigerant condenser, or cause the water coil type exchanger to act as a refrigerant condenser, and the air conditioning heat exchanger to act as a refrigerant evaporator; the improvement comprising: a longitudinally extending temperature sensing device axially disposed within the water coil, the sensing device being thermodynamically sensitive along a preselected distance thereof; and, thermostat control means adapted to control the air conditioning unit when the temperature of the water reaches a preselected temperature, the thermostat control means being operable in response to the temperature sensing device.

It is to be understood that the description of the examples of the present invention given hereinafter are not by way of limitation and various modifications within the scope of the present invention will occur to those skilled in the art upon reading the disclosure set forth hereinafter.

Figure 2:
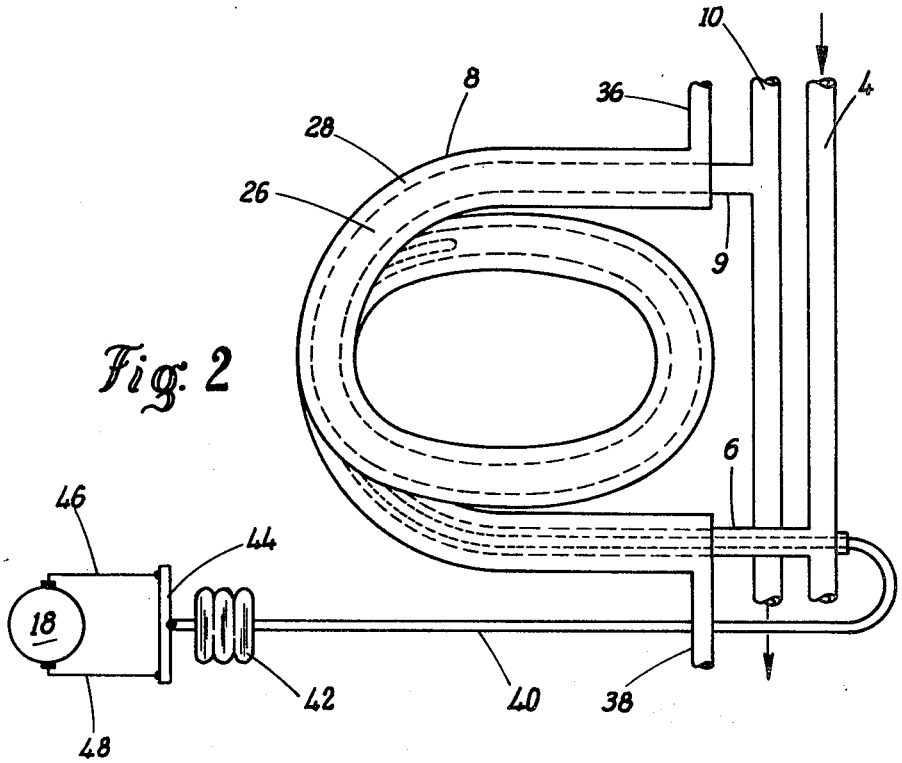

Referring to the drawing:

FIG. 1 is a somewhat schematic representation of a heating and cooling system for a building incorporating the invention; and, FIG. 2 is an enlarged schematic of a tube-in-tube heat exchanger of FIG. 1 showing one preferred thermostat control means of the present invention.

Referring to FIG. 1, a closed circuit heat pump system in a building having a plurality of zones, only two zones identified as I and II are illustrated. Zone I is illustrated as being cooled and Zone II is illustrated as being heated. The closed circuit heat pump system includes a pump 2 for circulating water throughout the building including a plurality of zones or rooms which includes circulating air therein which is treated by individual air conditioning units within the room. A conduit 3 is disposed on the discharge side of the pump 2 connecting the pump 2 with a water inlet header 4, conduit 3 being the transferring means for water from pump 2 to header 4. The water inlet header 4 has a plurality of conduit branches extending therefrom, only two branches being exemplified, namely, branch 5 and branch 6. Each branch extending from the header 4 is adapted to communicate with the inlet water tube 26 of a tube-in-tube heat exchanger 8, tube-in-tube heat exchanger 8 being one example of a heat exchanger of the type having a water coil within a housing. The branch conduits 5 and 6 are adapted for transferring water from the header 4 to each exchanger 8. An outlet water header 10 is provided in the closed circuit as a means for returning water which has been subjected to heat treatment in the tube-in-tube heat exchanger 8 to a treating area in the closed circuit wherein the water will either be heated or cooled depending on the treatment necessary to maintain a heat balance in the individual zones within the building. A heat reject heat exchanger 12 is incorporated within the circuit to remove heat from the circulating water when the primary purpose of the system is to cool, whereas a supplementary heater 14 is incorporated when the primary function of the system is to heat the air within the zones. In FIG. 1, heat rejecting exchanger 12 and supplementary heater 14 are disposed in series with the header 10 and in communication therewith. It is to be realized that by-pass valving (not shown) may be incorporated around either exchanger 12 or heater 14, depending upon which unit is not needed in the closed system. Heat rejecting heat exchanger 12 may be any known type such as a water-to-water heat exchanger, a closed circuit evaporative cooler, or the like. Also, the supplementary heater 14 may be any known type of heat exchanger which adds heat to the water, such as a water-to-water heat exchanger, a boiler, or the like.

Each individual zone is to be treated by a separate air conditioning unit 16 therein which in turn is treated by the flowing water. Air conditioning unit 16 includes a motor driven compressor 18, a first heat exchanger 20 to condition the air and the water contact tube-in-tube heat exchanger 8. A fan 26 is provided to draw air from the room and circulate it in heat exchange relation with the first heat exchanger 20. Motors, dampers, and controls for operating the fan 24 in combination with the heat exchanger 20 are well known in the art and are not shown in the figures.

The heat exchanger 8 is of the tube-in-tube type wherein water circulates through the inner tube 26 and refrigerant flows in the outer tube 28.

A reversing valve 30 is provided to control the direction of flow of refrigerant to the heat exchangers 20 and 8. The position of valve 30 in Zone I shows compressed refrigerant vapor flowing from the compressor discharge 32 to the heat exchanger 8 wherein heat exchanger 8 is operating as a condenser. Thus, heat exchanger 20 is operating as an evaporator wherein air moving across the heat exchanger 20 gives up heat to the condensed refrigerant and the air is therefore cooled thereby. In Zone II, valve 30 is positioned whereby the compressed refrigerant vapor from the compressor 18 is directed firstly to the heat exchanger 20 wherein heat exchanger 20 is operating as a condenser thereby adding heat to the air passing across the heat exchanger 20. The condensed refrigerant leaving the heat exchanger 20 is then subjected to treatment by the flowing water in the tube-in-tube exchanger 8 wherein the refrigerant absorbs heat from the flowing water in the tube 26.

An expansion device such as a capillary tube or expansion valve 34 is provided to separate the heat transfer zones of the two heat exchangers 20 and 8.

FIG. 2 is one preferred heat exchanger 8 of the present invention including thermostat control means for monitoring the temperature of the water in tube 26 and shutting down the air conditioning unit 16 in case the temperature of the water drops to or below a preselected temperature. The tube-in-tube heat exchanger 8 includes an inner tube 26 which is disposed to communicate with the inlet water header 4 through branch conduit 6 at its inlet and outlet water header 10 through branch conduit 9 at its outlet. An outer tube 28 is provided to communicate with refrigerant conduits 36 and 38. As noted in Zone I, when the air conditioning unit is on cooling, conduit 36 is an inlet conduit for the outer tube 28 and conduit 30 is an outlet refrigerant conduit. In Zone II, it is noted that when the air conditioning unit is on heating, conduit 38 is the inlet conduit and the outlet conduit for the refrigerant is conduit 36. It is realized that heat exchangers other than the tube-in-tube type may be used in the present invention, such as, for example, a water coil disposed within a shell containing a refrigerant wherein, as discussed hereinafter, the temperature sensing device is disposed axially within the water coil a selected distance therein.

When the air conditioning unit is on heating, as mentioned above in the discussion of Zone II, there is considerable concern about the condensed refrigerant coming in through conduit 38 at such a low temperature that as it extracts heat from the flowing water in tube 26 it is possible to decrease the temperature of the water in tube 26 to its freezing point thereby stopping the flow of the water through the unit and causing considerable damage to the unit or else making the air conditioning unit ineffective. Therefore, a longitudinally extending temperature sensing device 40 which may be, for example, a fluid filled capillary, a thermistor, thermocouple and the like is axially disposed within the inner tube 26 to a preselected position within the tube to monitor the temperature of the flowing water. The temperature sensing device is thermodynamically sensitive along a preselected distance thereof thereby measuring the water temperature along a preselected distance in the water coil. In the present example, temperature sensing device 40 is a fluid filled capillary connected through a tube to a bellows 42 which is mechanically connected to an extension of a pivoted switch means 44. The arrangement is such that when the temperature of the circulating water in the tube 26 drops to a predetermined temperature the switch means 44 opens the circuit which includes the compressor motor 18. Thus, if the flowing water in the tube 26 drops to a preselected temperature at any point along the temperature sensing device 40, such as slightly above freezing, as soon as the water approaches or gets to this preselected temperature, the circuit including the compressor will shut down thereby allowing the water in tube 26 to return to approximately its entering temperature thereby preventing the freeze-up of water within the tube 26. It is also realized that other factors may effect the operation of the heat exchanger 8 besides the refrigerant at an extremely low temperature. For example, water flow in the header may be restricted by a plug in the line due to the inadvertent closing of a valve or the lodging of a piece of debris in the header line wherein the volume of water going to the exchanger will be diminished. In this case, the temperature sensing element will sense a drop in temperature within the heat exchanger where the water coil or tube is surrounded by refrigerant so that the drop in water temperature due to no flow or a reduced flow will be sensed and the compressor will be stopped.

It will be realized that various changes may be made to the specific embodiments shown without departing from the principles and spirit of the present invention.

What is claimed is:

1. In a heating and cooling system for buildings, said system being operable to provide simultaneous and selective heating or cooling in a plurality of zones, said system comprising at least one air conditioning unit per zone, said air conditioning unit comprising reversible refrigeration machines which individually include a heat exchanger having a water coil therein, a refrigerant compressor, an air conditioning heat exchanger, and refrigerant control means operable to selectively cause said water coil type exchanger to act as a refrigerant evaporator and said air conditioning heat exchanger to act as a refrigerant condenser, or cause said water coil type exchanger to act as a refrigerant condenser and said air conditioning heat exchanger to act as a refrigerant evaporator; the improvement comprising: means for preventing the freeze-up of water in said water coil including a longitudinally extending temperature sensing device axially extending a substantial distance within said water coil, said sensing device being thermodynamically sensitive along a preselected distance thereof; and, thermostat control means adapted to control said air conditioning unit when the temperature of the water reaches a preselected temperature, said thermostat control means being operable in response to said temperature sensing device.

2. The combination as described in claim 1 wherein said water coil is in the inner tube of a tube-in-tube exchanger and the outer tube contains a refrigerant therein.

3. The combination as described in claim 1 wherein said thermostat control means is in electrical communication with said refrigerant compressor whereby when said water reaches a preselected temperature, said compressor is de-energized.

* * * * *